US006877467B2

(12) United States Patent
Katayama

(10) Patent No.: US 6,877,467 B2
(45) Date of Patent: Apr. 12, 2005

(54) FOUR-CYCLE ENGINE

(75) Inventor: Goichi Katayama, Shizuoka (JP)

(73) Assignee: Yamaha Marine Kabushiki Kaisha, Shizuoka-Ken (JP)

( * ) Notice: Subject to any disclaimer, the term of this patent is extended or adjusted under 35 U.S.C. 154(b) by 0 days.

(21) Appl. No.: 10/300,187

(22) Filed: Nov. 20, 2002

(65) Prior Publication Data

US 2003/0094152 A1 May 22, 2003

(30) Foreign Application Priority Data

Nov. 20, 2001 (JP) ..... 2001-354215

(51) Int. Cl.[7] ..... F01L 1/34
(52) U.S. Cl. ..... 123/90.17; 123/90.31
(58) Field of Search ..... 123/90.31, 90.17

(56) References Cited

U.S. PATENT DOCUMENTS

| | | | | |
|---|---|---|---|---|
| 4,993,374 A | | 2/1991 | Okui | |
| 5,178,108 A | | 1/1993 | Beaber | |
| 5,564,380 A | | 10/1996 | Kobayashi et al. | |
| 5,704,819 A | | 1/1998 | Isogawa | |
| 5,718,196 A | | 2/1998 | Uchiyama et al. | |
| 5,724,930 A | | 3/1998 | Sakurai et al. | |
| 5,740,768 A | | 4/1998 | Sakurai et al. | |
| 5,797,361 A | * | 8/1998 | Mikame et al. | 123/90.17 |
| 5,865,655 A | | 2/1999 | Hiraoka et al. | |
| 5,941,205 A | | 8/1999 | Hiraoka et al. | |
| 6,044,817 A | | 4/2000 | Hiraoka et al. | |
| 6,250,266 B1 | * | 6/2001 | Okui et al. | 123/90.17 |
| 2002/0017277 A1 | | 2/2002 | Kanno | |

FOREIGN PATENT DOCUMENTS

| | | | |
|---|---|---|---|
| EP | 624717 A1 * | 11/1994 | F01L/1/34 |
| JP | 08-068340 | 3/1996 | |
| JP | 09-041909 | 2/1997 | |
| JP | 10-002229 | 1/1998 | |

OTHER PUBLICATIONS

US 5,848,578, 12/1998, Uchiyama et al. (withdrawn)

Co–pending patent application: U.S. Appl. No. 09/358,992 filed Jul. 22, 1999; entitled Four Stroke Engine for Outboard Motor; in the name of Yutaka Okamoto; and assigned to Sanshin Kogyo Kabushiki Kaisha.

* cited by examiner

*Primary Examiner*—Thomas Denion
*Assistant Examiner*—Zelalem Eshete
(74) *Attorney, Agent, or Firm*—Knobbe, Martens, Olson & Bear LLP

(57) ABSTRACT

An engine includes an engine body that defines first and second banks arranged in a V-shape. A crankshaft extends within the engine body. First and second camshafts extend within the first bank, and third and fourth camshafts extend within the second bank. The first, second, third and fourth camshafts are generally disposed parallel to each other and parallel to the crankshaft. The first and third camshafts are placed next to each other. A first flexible transmitter surrounds the crankshaft and the first and third camshafts. The crankshaft drives the first and third camshafts through the first transmitter. A second flexible transmitter surrounds the second and fourth camshafts and either the first or third camshaft. The first or third camshaft drives the second and fourth camshafts through the second transmitter. The engine also includes VVT mechanisms to change an angular position of the camshafts relative to the crankshaft. The VVT mechanisms are disposed at the camshafts. Each VVT mechanism at least in part overlaps with either the first or second transmitter in a direction of an axis of the associated camshaft.

24 Claims, 5 Drawing Sheets

FOUR-CYCLE ENGINE

PRIORITY INFORMATION

This application is based on and claims priority to Japanese Patent Application No. 2001-354215, filed Nov. 20, 2001, the entire contents of which is hereby expressly incorporated by reference.

BACKGROUND OF THE INVENTION

1. Field of the Invention

The present invention generally relates to a four-cycle engine, and more particularly relates to a four-cycle engine having an overhead camshaft drive.

2. Description of Related Art

Recently, outboard motors tend to use four-cycle engines for highly emission control. Such four-cycle engines typically comprise a crankshaft that drives a submerged marine propulsion device through suitable shaft couplings. Modem four-cycle engines typically employ an overhead camshaft drive system. In this system, the crankshaft also drives a camshaft(s) which actuates intake and exhaust valves. Normally, at least one flexible transmitter, such as a drive belt or chain, for example, that is disposed atop the engine, drives the camshaft(s). For instance, U.S. Pat. Nos. 5,564,380, 5,704,819, 5,848,578, 5,865,655 and 6,044,817 disclose such camshaft drives.

Some four-cycle engines can have an engine body defining first and second banks together forming a V-shape. Each bank can have intake and exhaust camshafts. The crankshaft can drive the entire intake and exhaust camshafts through a single flexible transmitter. However, the transmitter can be relatively long in this arrangement and is apt to make maintenance services troublesome. Normally, therefore, the crankshaft in another arrangement first drives the intake or exhaust camshaft in each bank through a first transmitter. Then, the intake or exhaust camshaft drives the other exhaust or intake camshaft in the same bank through a second transmitter. Three transmitters in total are used in this arrangement because two second transmitters are necessary.

Additionally, the flexible transmitter can elongate the camshaft because the transmitter needs a sprocket or pulley attached at the camshaft. Accordingly, the engine can be large to incorporate such a long camshaft.

The four-cycle engines also can be provided with a variable valve timing (VVT) mechanism to obtain high charging efficiency in a relatively high engine speed range and low fuel consumption and superior exhaust characteristics in a relatively low engine speed range. The VVT mechanism can change valve timings of either the intake or exhaust valves in response to the engine speeds. The VVT mechanism can be operated hydraulically and can include a control valve unit that controls the hydraulic operation of the VVT mechanism. The VVT mechanism often is disposed at the camshaft associated with intake or exhaust valves that need the valve timing change. The control valve unit, more specifically, controls flow of fluid in the VVT mechanism to change angular positions of the camshaft.

Due to being disposed at the portion of the camshaft, the VVT mechanism and more particularly, the control valve unit inevitably elongates the camshaft. The engine thus is larger because of the VVT mechanism and the camshaft drive, as noted above.

SUMMARY OF THE INVENTION

An aspect of the present invention involves the recognition of the need for an improved four-cycle engine that can make the engine itself smaller even though both the VVT mechanism and the camshaft drive are provided. Additionally, a need exists for an improved four-cycle engine that can decrease troubles in maintenance services and also can reduce the number of transmitters.

To address one or more of such needs, an aspect of the present invention involves an internal combustion engine comprises an engine body defining first and second banks forming a V-shape. A crankshaft extends within the engine body. First and second camshafts extend within the first bank. Third and fourth camshafts extend within the second bank. The first, second, third and fourth camshafts are generally disposed parallel to each other and parallel to the crankshaft. The first and third camshafts are placed next to each other. A first flexible transmitter extends about the crankshaft and the first and third camshafts. The crankshaft drives the first and third camshafts through the first transmitter. A second flexible transmitter extends about the second and fourth camshafts and either the first or third camshaft. The first or third camshaft drives the second and fourth camshafts through the second transmitter. The first and second transmitters are arranged next to each other in a direction extending generally parallel to an axis of the crankshaft.

In accordance with another aspect of the present invention, an internal combustion engine for an outboard motor comprises an engine body. A crankshaft extends generally vertically within the engine body. At least one camshaft extends generally vertically and generally parallel to the crankshaft within the engine body. A transmitting device is arranged to transmit driving force to the camshaft from the crankshaft. A change mechanism is configured to change an angular position of the camshaft relative to the crankshaft. At least a portion of the change mechanism is disposed generally next to at a portion of the camshaft. The transmitting device at least in part overlaps with the portion of the change mechanism in a vertical direction.

BRIEF DESCRIPTION OF THE DRAWINGS

These and other features, aspects and advantages of the present invention will now be described with reference to the drawings of preferred embodiments, which embodiments are intended to illustrate and not to limit the present invention. The drawings comprise five figures.

DETAILED DESCRIPTION OF PREFERRED EMBODIMENTS OF THE PRESENT INVENTION

Figure 1:
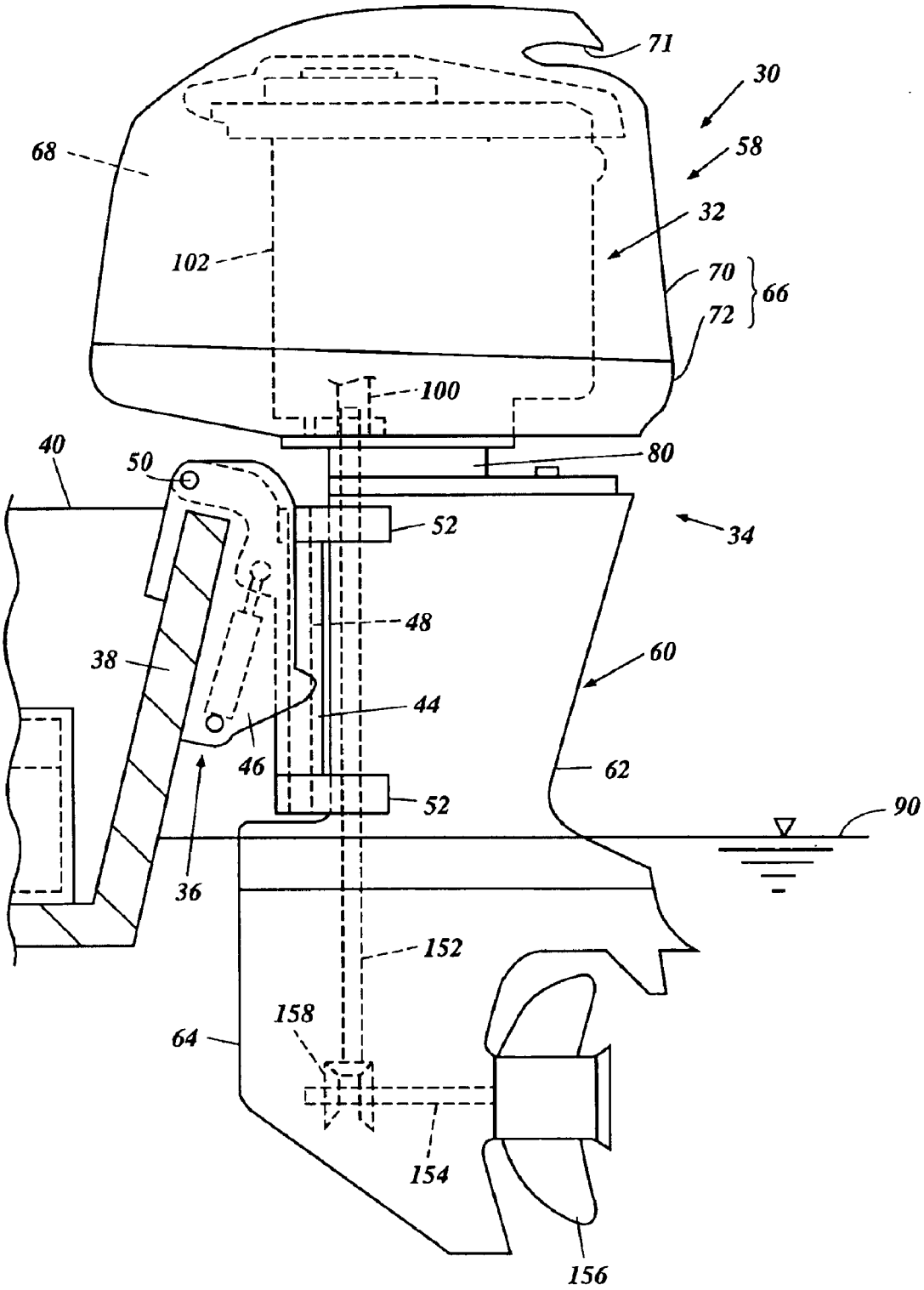
FIG. 1 is a side elevational view of an outboard motor incorporating an engine configured in accordance with certain features, aspects and advantages of the present invention. An associated watercraft is partially shown and several internal components of the outboard motor, including the engine, are illustrated in phantom.
Figure 2:
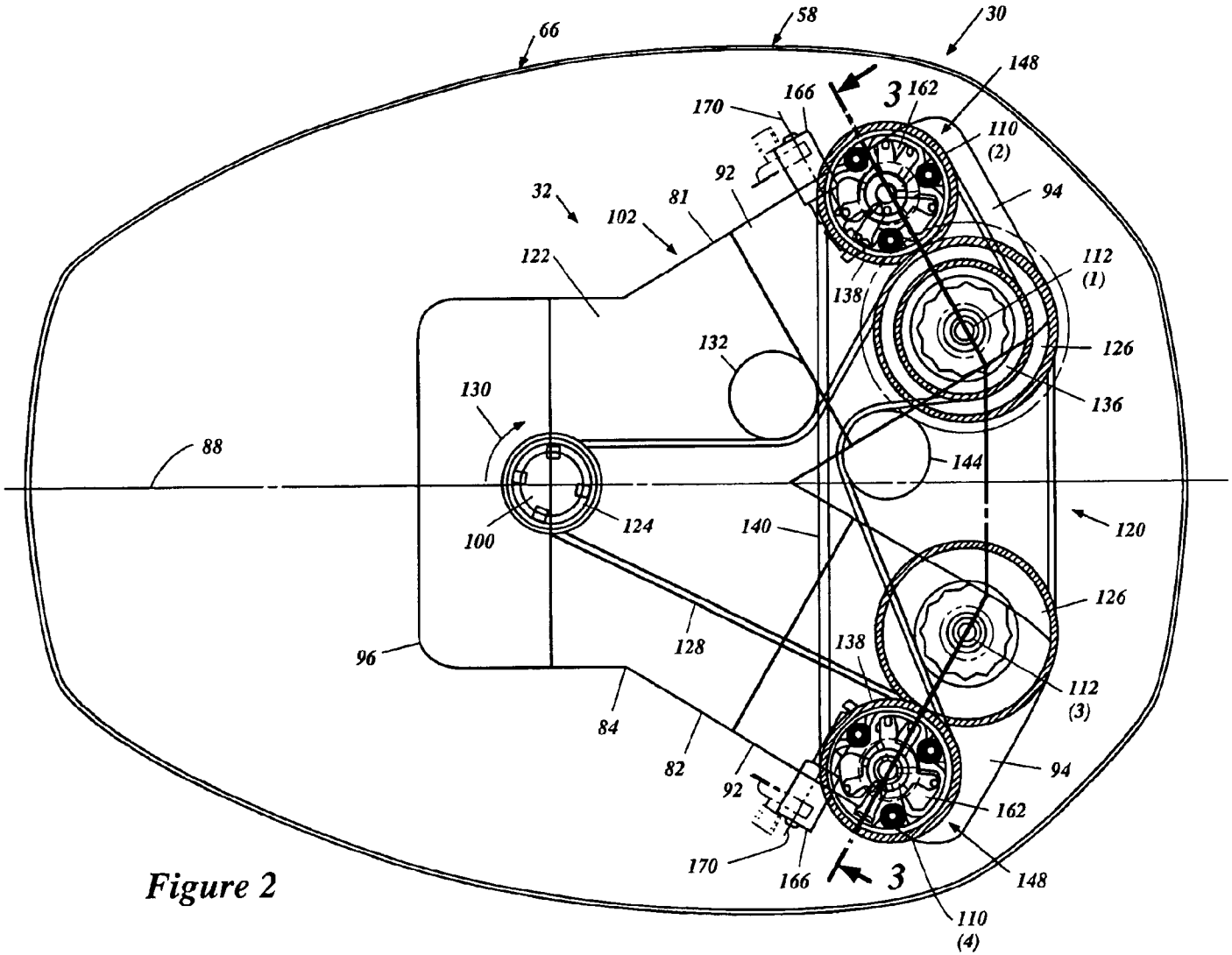
FIG. 2 is a top plan view of the outboard motor of FIG. 1. A top cowling of the outboard motor is detached in this figure to show the engine. The engine is somewhat schematically illustrated to explicitly show part of VVT mechanisms of the engine.
Figure 3:
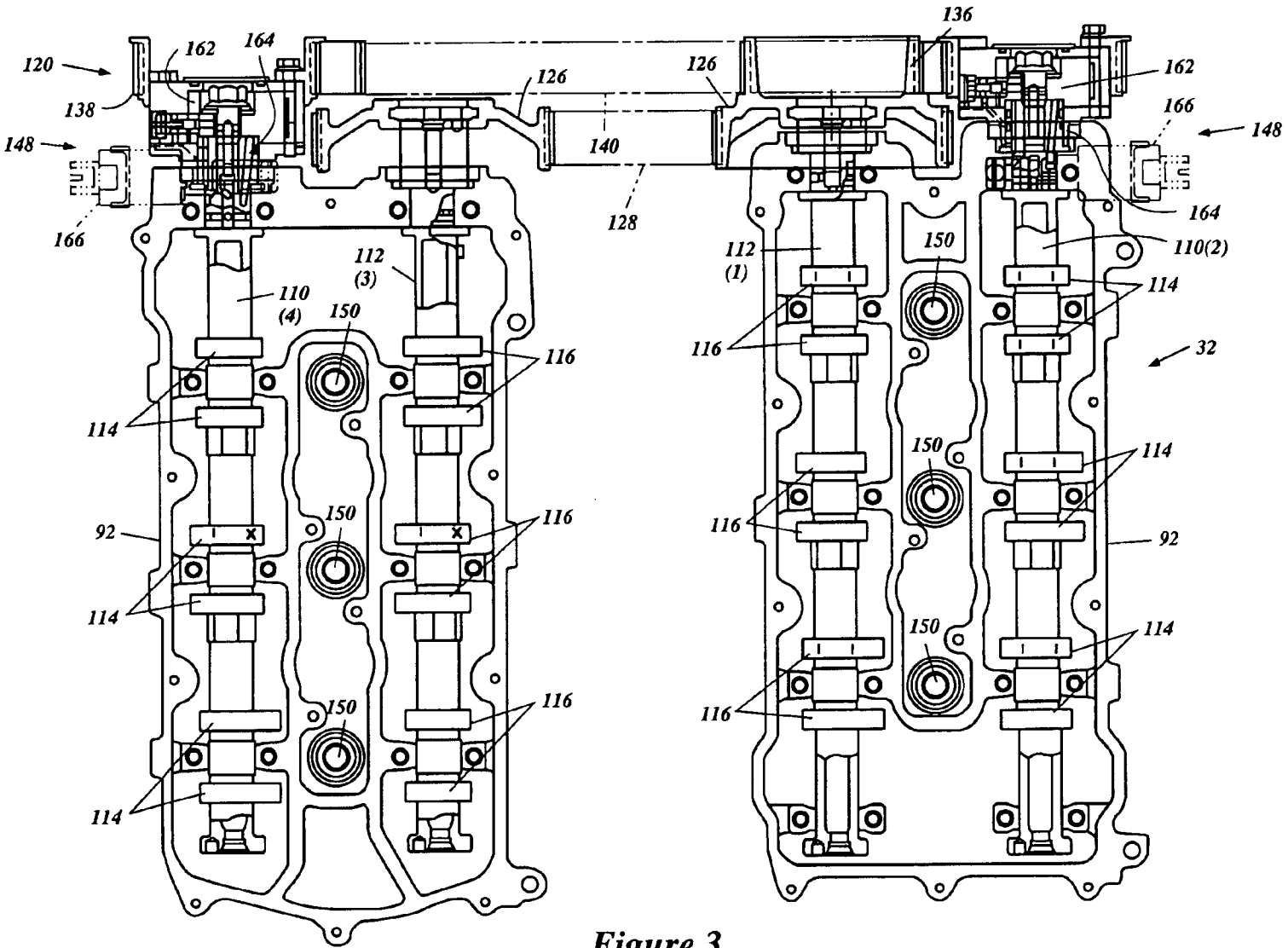
FIG. 3 is a cross-sectional view of the engine taken along the line 3—3 of FIG. 2.

With reference to FIGS. 1–3, an outboard motor 30 incorporating an internal combustion engine 32 configured in accordance with certain features, aspects and advantages of the present invention will be described. The engine 32 has particular utility in the context of an outboard motor, and thus is described in the context of an outboard motor. The engine 32, however, can be used with other types of marine drives (i.e., inboard motors, inboard/outboard motors, etc.) and also certain land vehicles and equipment. Furthermore, the engine 32 can be used as a stationary engine for some applications that will become apparent to those of ordinary skill in the art.

In the illustrated arrangement, the outboard motor 30 generally comprises a drive unit 34 and a bracket assembly 36. The bracket assembly 36 supports the drive unit 34 on a transom 38 of an associated watercraft 40 and places a marine propulsion device in a submerged position with the watercraft 40 resting relative to a surface of a body of water. The bracket assembly 36 preferably comprises a swivel bracket 44, a clamping bracket 46, a steering shaft 48 and a pivot pin 50.

The steering shaft 48 typically extends through the swivel bracket 44 and is affixed to the drive unit 34 with upper and lower mount dampers 52. The steering shaft 48 can be pivotally journaled for steering movement about a generally vertically extending steering axis defined within the swivel bracket 44. The clamping bracket 46 comprises a pair of bracket arms that preferably are laterally spaced apart from each other and that are attached to the watercraft transom 38.

The pivot pin 50 completes a hinge coupling between the swivel bracket 44 and the clamping bracket 46. The pivot pin 50 preferably extends through the bracket arms so that the clamping bracket 46 supports the swivel bracket 44 for pivotal movement about a generally horizontally extending tilt axis defined by the pivot pin 50. The drive unit 34 thus can be tilted or trimmed about the pivot pin 50.

As used through this description, the terms "forward," "forwardly" and "front" mean at or to the side where the bracket assembly 36 is located, unless indicated otherwise or otherwise readily apparent from the context use. The terms "rear," "reverse," "backwardly" and "rearwardly" mean at or to the opposite side of the front side.

A hydraulic tilt and trim adjustment system preferably is provided between the swivel bracket 44 and the clamping bracket 46 for tilt movement (raising or lowering) of the swivel bracket 44 and the drive unit 34 relative to the clamping bracket 46. In some arrangements, the outboard motor 30 can have a manually operated system for tilting the drive unit 34. Typically, the term "tilt movement," when used in a broad sense, comprises both a tilt movement and a trim adjustment movement.

The illustrated drive unit 34 comprises a power head 58 and a housing unit 60, which includes a driveshaft housing 62 and a lower unit 64. The power head 58 is disposed atop the housing unit 60 and includes the engine 32 that is enclosed within a protective cowling assembly 66, which preferably is made of plastic. In most arrangements, the protective cowling assembly 66 defines a generally closed cavity 68 in which the engine 32 is disposed. The engine, thus, is generally protected within the enclosure, which is defined by the cowling assembly 66, from environmental elements.

The protective cowling assembly 66 preferably comprises a top cowling member 70 and a bottom-cowling member 72. The top cowling member 70 preferably is detachably affixed to the bottom cowling member 72 by a coupling mechanism to facilitate access to the engine and other related components.

The top cowling member 70 preferably has a rear intake opening 71 defined through an upper rear portion. A rear intake member with one or more air ducts can be unitarily formed with, or affixed to, the top cowling member 70. The rear intake member, together with the upper rear portion of the top cowling member 70, generally defines a rear air intake space. Ambient air is drawn into the closed cavity 68 via the rear intake opening and the air ducts of the rear intake member. Typically, the top cowling member 70 tapers in girth toward its top surface, which is in the general proximity of the air intake opening. The taper helps to reduce the lateral dimension of the outboard motor, which helps to reduce the air drag on the watercraft 40 during movement.

The bottom-cowling member 72 preferably has an opening through which an upper portion of an exhaust guide member 80 extends. The exhaust guide member 80 preferably is made of aluminum alloy and is affixed atop the driveshaft housing 62. The bottom cowling member 72 and the exhaust guide member 80 together generally form a tray. The engine 32 is placed onto this tray and can be connected to the exhaust guide member 80. The exhaust guide member 80 also defines an exhaust discharge passage through which burnt charges (e.g., exhaust gases) from the engine 32 pass.

The engine 32 in the illustrated embodiment preferably operates on a four-cycle combustion principle. With reference now to FIGS. 2 and 3, the presently preferred engine 32 is a double overhead camshaft (DOHC), six-cylinder engine and has a V-shaped cylinder block 84. The cylinder block 84 thus defines two cylinder banks B1, B2, which extend generally side by side with each other. In this description, the bank B1 is located on the starboard side, while the bank B2 is located on the port side. Each cylinder bank B1, B2 preferably has three cylinder bores such that the cylinder block 84 has six cylinder bores in total. The cylinder bores of each bank B1, B2 extend generally horizontally and are generally vertically spaced from one another. In some aspects of the present invention, however, this type of engine merely exemplifies one type of engine. Engines having other numbers of cylinders and having other cylinder arrangements (in-line, opposing, etc.) also can be used with some aspects of the present invention. The illustrated engine 32 generally is symmetrical about a longitudinal center plane 88 (FIG. 2) that extends generally vertically and fore to aft of the outboard motor 30.

As used in this description, the term "horizontally" means that the subject portions, members or components extend generally parallel to the water surface 90 (FIG. 1), i.e., generally normal to the direction of gravity, when the associated watercraft 40 is substantially stationary with respect to the water surface and when the drive unit 34 is not tilted (i.e., is placed in the position shown in FIG. 1). The term "vertically" in turn means that portions, members or components extend generally normal to those that extend horizontally.

A moveable member moves relative to the cylinder block 84 in a suitable manner. In the illustrated arrangement, a piston (not shown) reciprocates within each cylinder bore.

Because the cylinder block 84 is split into the two cylinder banks, each cylinder bank B1, B2 extends outward at an angle to an independent first end in the illustrated arrangement. A pair of cylinder head members (first members) 92 are affixed to the respective first ends of the cylinder banks B1, B2 to close those ends of the cylinder bores. The cylinder head members 92, together with the associated pistons and cylinder bores, preferably define six combustion chambers (not shown). Of course, the number of combustion chambers can vary, as indicated above. Each of the cylinder head member 92 is covered with a cylinder head cover member (second member) 94.

A crankcase member 96 is coupled with the cylinder block 84. The crankcase member 96 closes the other end of the cylinder bores and, together with the cylinder block 84, define a crankcase chamber. A crankshaft 100 extends generally vertically through the crankcase chamber and can be journaled for rotation about a rotational axis by several bearing blocks. The rotational axis of the crankshaft 100 preferably is on the longitudinal center plane 88. Connecting rods couple the crankshaft 100 with the respective pistons in any suitable manner. Thus, the reciprocal movement of the pistons rotates the crankshaft 100.

Preferably, the crankcase member 96, with the cylinder block 84, the cylinder head members 92 and the cylinder head cover members 94 being disposed rearward from the crankcase member 96, one after another. In the illustrated arrangement, the cylinder block 84, the cylinder head members 92, the cylinder head cover members 94 and the crankcase member 96 together define an engine body 102. Preferably, at least these major engine portions 84, 92, 94, 96 are made of aluminum alloy. In some arrangements, the cylinder head cover members 94 can be unitarily formed with the respective cylinder head members 92.

The engine 32 also comprises an air intake system. The air intake system (not shown) draws air from within the cavity 68 to the combustion chambers. The air intake system preferably comprises six intake passages and a pair of plenum chambers. In the illustrated arrangement, each cylinder bank B1, B2 communicates with three intake passages and one plenum chamber. In one alternative arrangement, a single plenum chamber can replace the plenum chambers.

The most-downstream portions of the intake passages are defined within the cylinder head members 92 as inner intake passages. The inner intake passages communicate with the combustion chambers through intake ports, which are formed at inner surfaces of the cylinder head members 92. Typically, each of the combustion chambers has one or more intake ports. In this arrangement, two intake ports are provided for each combustion chamber. Intake valves are slideably disposed at each cylinder head members 92 to move between an open position and a closed position. As such, the valves act to open and close the ports to control the flow of air into the combustion chamber. Biasing members, such as springs, are used to urge the intake valves toward the respective closed positions by acting between a mounting boss formed on each cylinder head member 92 and a corresponding retainer that is affixed to each of the valves. When each intake valve is in the open position, the inner intake passage that is associated with the intake port communicates with the associated combustion chamber.

Outer portions of the intake passages, which are disposed outside of the cylinder head members 92, preferably are defined with intake conduits. In the illustrated arrangement, each intake conduit includes a throttle body in which a throttle valve assembly is positioned. The respective intake conduits extend forwardly along side surfaces of the engine body 102 on both the port side and the starboard side from the respective cylinder head members 92 to the front of the crankcase case member 96. The intake conduits on the same side extend generally in parallel to each other and are vertically spaced apart from one another.

Each throttle valve assembly preferably includes a throttle valve. Preferably, the throttle valves are butterfly valves that have valve shafts journaled for pivotal movement about a generally vertical axis. In some arrangements, the valve shafts are linked together and are connected to a control linkage. The control linkage would be connected to an operational member, such as a throttle lever, that is provided on the watercraft or otherwise proximate the operator of the watercraft 40. The operator can control the opening degree of the throttle valves in accordance with operator demand through the control linkage. That is, the throttle valve assemblies can measure or regulate amounts of air that flow through the intake passages to the combustion chambers in response to the operation of the operational member by the operator. Normally, the greater the opening degree, the higher the rate of airflow and the higher the engine speed.

The respective plenum chambers preferably are defined with plenum chamber units that are disposed side by side in front of the crankcase member 96 and are affixed thereto. The plenum chambers define air inlets through which air is drawn into the plenum chambers. The plenum chambers coordinate or smooth air delivered to each intake passage and also act as silencers to reduce intake noise.

The air drawn into the plenum chambers enters the outer intake passages and flows into the inner intake passages. The throttle valve assemblies regulate the level of airflow before the air enters the inner intake passages.

The engine 32 further comprises an exhaust system (not shown) that routes burnt charges, i.e., exhaust gases, to a location outside of the outboard motor 30. Each cylinder head member 92 defines a set of inner exhaust passages that communicate with the combustion chambers through one or more exhaust ports. In this arrangement, two exhaust ports are provided for each combustion chamber. The exhaust ports can be defined at the other side surfaces of the respective cylinder head members 92 that are opposed to the side surfaces from which the intake conduits extend. The other side surfaces of both the banks B1, B2 together form a valley therebetween. The exhaust ports can be selectively opened and closed by exhaust valves. The construction of each exhaust valve and the arrangement of the exhaust valves are substantially the same as the intake valve and the arrangement thereof, respectively.

Exhaust manifolds preferably are defined generally vertically within the cylinder block 84 between the cylinder bores of both the cylinder banks B1, B2 and generally in the valley. The exhaust manifolds communicate with the combustion chambers through the inner exhaust passages and the exhaust ports to collect exhaust gases therefrom. The exhaust manifolds are coupled with the exhaust discharge passage of the exhaust guide member 80. When the exhaust ports are opened, the combustion chambers communicate with the exhaust discharge passage through the exhaust manifolds.

A valve cam mechanism preferably is provided for actuating the intake and exhaust valves in each cylinder bank B1, B2. Preferably, the valve cam mechanism includes an intake camshaft 110 and an exhaust camshaft 112 per cylinder bank B1, B2. In this description, the exhaust camshaft 112 on the bank B1 forms a first camshaft (1), the intake camshaft 110 on the bank B1 forms a second camshaft (2), the exhaust camshaft on the bank B2 forms a third camshaft (3), and the intake camshaft on the bank B2 forms the fourth camshaft (4). The intake and exhaust camshafts 110, 112 preferably extend generally vertically and are journaled for rotation between the cylinder head members 92 and the cylinder head cover members 94. In the illustrated embodiment, each camshaft 110, 112 is supported on the respective cylinder head by one or more bearing caps. The intake and exhaust camshafts 110, 112 have intake and exhaust cam lobes 114, 116, respectively, to push valve lifters that are affixed to the respective ends of the intake and exhaust valves in any suitable manner. In the illustrated embodiment, one cam lobe 114, 116 is allotted to each valve. The cam lobes 114, 116 repeatedly push the valve lifters in a timed manner, which is in proportion to the engine speed. The movement of the lifters generally is timed by rotation of the camshafts 110, 112 to appropriately actuate the intake and exhaust valves.

A camshaft drive mechanism 120 preferably is provided for driving the valve cam mechanism. The camshaft drive mechanism 120 is, in other words, a transmitting device that transmits driving force to the camshafts 110, 112 from the crankshaft 100. The camshaft drive mechanism 120 in the illustrated arrangement is formed above a top surface 122 of the engine body 102. In other words, the drive mechanism 120 extends out of the engine body 102. The illustrated camshaft drive mechanism 120 can be divided into first and second drives. The first drive drives a first group of the camshafts, which in this arrangement are the exhaust camshafts 112, i.e., the first and third camshafts (1), (3). The second drive drives a second group of the camshafts, which in the illustrated arrangement are the intake camshafts 110, i.e., the second and fourth camshafts (2), (4).

The first drive comprises a drive sprocket 124 positioned almost atop the crankshaft 100, driven sprockets 126 positioned atop the respective exhaust camshafts 112 of each bank B1, B2, and a flexible transmitter, such as a timing chain 128 (or timing belt), for example, wound around the drive sprocket 124 and the driven sprockets 126. That is, the drive and driven sprockets 124, 126 are located on the same level and the timing chain 128 surrounds the crankshaft 100 and the exhaust camshafts 112. The timing chain 128 forms a first flexible transmitter in this description.

The crankshaft 100 thus drives the respective exhaust camshafts 112 through the timing chain 128 in the timed relationship. The illustrated timing chain 128 moves in a direction indicated by the arrow 130 of FIG. 2. The diameter of each illustrated driven sprocket 126 is twice as larger as the diameter of the drive sprocket 124 such that the exhaust camshafts 112 rotate at half of the crankshaft speed. A chain tensioner 132 provided at a loose side of the timing chain 128 advantageously maintains the chain 128 under a desired degree of tension. The illustrated chain tensioner 132 generally has a cylindrical shape. In this arrangement, the chain tensioner 132 is located in one half of the engine body 102 that includes the bank B1 relative to the center plane 88.

The second drive comprises a drive sprocket 136, driven sprockets 138 and a flexible transmitter, such as a timing chain 140, for example. The illustrated drive sprocket 136 is unitarily formed with the driven sprocket 138 and above the drive sprocket 126, although the drive and driven sprockets 136, 138 can be separately formed. The driven sprockets 138 are positioned atop the respective intake camshafts 112 in each bank B1, B2. The timing chain 140 (or belt) is wound around the drive sprocket 136 and the driven sprockets 138. That is, the drive and driven sprockets 136, 138 are located on the same level and the timing chain 140 surrounds the exhaust camshaft 112 on the bank B1 that has the drive sprocket 136 and the intake camshafts 110. Also, the timing chain 140 is located above the timing chain 128 in this arrangement. The timing chain 140 forms a second flexible transmitter in this description of the illustrated embodiment.

The exhaust camshaft 112, which is driven by the crankshaft 100, thus drives the respective intake camshafts 110 through the timing chain 140 in the timed relationship. The diameter of the illustrated drive sprocket 136 is smaller than the driven sprocket 126. The diameter of each driven sprocket 138 is equal to one another and also is equal to the diameter of the drive sprocket 136. A chain tensioner 144 provided at a loose side of the timing chain 140 advantageously maintains the chain 140 under a desired degree of tension. The illustrated chain tensioner 144 generally has a cylindrical shape. In this arrangement, at least the center of the chain tensioner 144 is located in one half of the engine body 102 that includes the bank B2 relative to the center plane 88.

As thus described, the illustrated engine uses two timing chains 128, 140. Each timing chain 128, 140 is not long in comparison with a single chain. In addition, the number of the chains 128, 140 is less than three. Accordingly, possible troubles in maintenance services can be decreased.

The illustrated engine 32 also is provided with variable valve timing (VVT) mechanisms 148 associated with the intake camshafts 110. The VVT mechanisms 148 can change valve timings of the intake valves in response to the engine speeds. The illustrated VVT mechanisms 148 are operated hydraulically and change an angular position of each intake camshaft 110 by controlling fluid flow in the mechanisms 148. Accordingly, the intake camshafts 110 can vary valve timings. The engine 32 thus can obtain high charging efficiency in a relatively high engine speed range and low fuel consumption and superior exhaust characteristics in a relatively low engine speed range. The VVT mechanism 148 will be described in greater details below.

The illustrated engine 32 can comprise either a direct or indirect fuel injection system. The illustrated fuel injection system preferably comprises six fuel injectors with one fuel injector allotted to each one of the respective combustion chambers. Each fuel injector preferably has an injection nozzle directed each combustion chamber or each associated intake passage. The fuel injectors spray fuel directly into the combustion chambers or into the intake passages under control of an electronic control unit (ECU) (not shown). The ECU controls both the initiation timing and the duration of the fuel injection cycle of the fuel injectors 144 so that the nozzles spray a desired amount of fuel each combustion cycle.

Other charge forming devices can be used instead of the fuel injection system. For example, one or more carburetors can be applied to supply the fuel to the combustion chambers.

The engine 32 further can comprise an ignition system. The combustion chambers are provided with spark plugs, which preferably are affixed, to plug holes 150 (FIG. 3) formed at each cylinder head member 92 and between the intake and exhaust valves. Each spark plug has electrodes that are exposed in the associated combustion chamber. The electrodes are spaced apart from each other by a small gap. The spark plugs are connected to the ECU through ignition coils. The spark plugs generate a spark between the electrodes to ignite an air/fuel charge in the combustion chamber according to desired ignition timing maps or other forms of controls.

Generally, during an intake stroke, air is drawn into the combustion chambers through the air intake passages and fuel is mixed with the air by the fuel injectors or carburetors. The mixed air/fuel charge is introduced to the combustion chambers. The mixture is then compressed during a compression stroke. Just prior to a power stroke, the respective spark plugs ignite the compressed air/fuel charge in the respective combustion chambers. The air/fuel charge thus rapidly bums during the power stroke to move the pistons. The burnt charge, i.e., exhaust gases, then is discharged from the combustion chambers during an exhaust stroke.

The engine 32 may comprise any other systems, mechanisms, devices, accessories and components other than those described above such as, for example, a cooling system and a lubrication system. In the illustrated embodiment, the VVT mechanisms 148 use part of the lubricant oil of the lubrication system as a working fluid.

With reference back to FIG. 1, the driveshaft housing 62 depends from the power head 58 and supports a driveshaft 152, which is coupled with the crankshaft 100 and which extends generally vertically through the driveshaft housing 62. The driveshaft 152 is journaled for rotation and is driven by the crankshaft 100.

The driveshaft housing 62 preferably defines an internal section of the exhaust system that leads the majority of exhaust gases to the lower unit 64. The internal section includes an idle discharge portion that extends from a main portion of the internal section to discharge idle exhaust gases directly to the atmosphere through a discharge port that is formed on a rear surface of the driveshaft housing 62 engine idle.

The lower unit 64 depends from the driveshaft housing 62 and supports a propulsion shaft 154 that is driven by the driveshaft 152. The propulsion shaft 154 extends generally horizontally through the lower unit 64 and is journaled for rotation. A propulsion device is attached to the propulsion shaft 154. In the illustrated arrangement, the propulsion device is a propeller 156 that is affixed to an outer end of the propulsion shaft 154. The propulsion device, however, can take the form of a dual counter-rotating system, a hydrodynamic jet, or any of a number of other suitable propulsion devices.

A transmission 158 preferably is provided between the driveshaft 152 and the propulsion shaft 154, which lie generally normal to each other (i.e., at a 90° shaft angle) to couple together the two shafts 152, 154 by bevel gears, for example. The outboard motor 30 has a clutch mechanism that allows the transmission to change the rotational direction of the propeller 156 among forward, neutral or reverse.

The lower unit 64 also defines an internal section of the exhaust system that is connected with the internal exhaust section of the driveshaft housing 62. At engine speeds above idle, the exhaust gases generally are discharged to the body of water surrounding the outboard motor 30 through the internal sections and then a discharge section defined within the hub of the propeller 156, for example.

With reference again FIGS. 2 and 3, each VVT mechanism 148 preferably comprises an angular position setting unit 162, a fluid supply unit 164 and a fluid control valve unit 166. The illustrated angular position setting unit 162 comprises a housing and three vanes affixed to the intake camshaft 110 and pivotal within the housing. The fluid supply unit 164 comprises fluid passages through which the working fluid, i.e., the lubricant oil in this arrangement, can be supplied to the setting unit 162. The fluid passages of the supply unit 164 include return passages through which the fluid can return to the lubrication system. The fluid, however, only move back and forth within limited areas and does not move between the lubricant system and the setting unit 162. The control valve unit 166 controls the movement of the fluid. The fluid controlled by the control valve unit 166 forces the vanes to pivot. Because being affixed to the intake camshaft 110, the vanes change the angular position of the intake camshaft 110. Accordingly, the intake camshaft 110 varies the valve timing of the intake valves that are associated with the camshaft 110.

Additional details of the VVT mechanism are disclosed in a co-pending U.S. patent application filed Jun. 11, 2001, titled FOUR-CYCLE ENGINE FOR MARINE DRIVE, which Ser. No. is 09/878,323, the entire contents of which is hereby expressly incorporated by reference.

Due to being disposed at camshafts 110, each VVT mechanism 148 and, more particularly the control valve unit 166, inevitably causes the associated camshaft 110 to be longer. On the other hand, the foregoing timing chains 128, 140 also inevitably elongate the camshafts 110, 112 because the timing chains 128, 140 need the driven and drive sprockets 126, 136, 138 that require space for attachment. In other words, the camshafts 110, 112 need space to incorporate the sprockets 126, 136, 138. Particularly, the illustrated intake camshafts 110 should have a longer length than the originally necessary length because the timing chain 140 is positioned above the timing chain 128.

The illustrated VVT mechanisms 148 are disposed at a top portion of each intake camshaft 110 just below the driven sprockets 138 where the timing chain 140 is wound around. Because the timing chain 128 is positioned below the timing chain 140, the VVT mechanisms 148 are positioned generally on the same level as the timing chain 128. In other words, at least a portion of each VVT mechanism 148 overlaps the timing chain 128 in a direction of the axis of the intake camshaft 110. In this arrangement, the control valve units 166 at least in part overlap with the timing chain 128 in that direction. Each illustrated control valve unit 166 preferably is located next to each cylinder head member 92 rather than the cylinder head cover member 94. More specifically, each control valve unit 166 is disposed closer to the crankshaft 100 than a mating line on which the cylinder head member 92 and the cylinder head cover member 94 mate with each other. Also, the longitudinal axis 170 of each control valve unit 166 extends generally normal to the side surface of the cylinder head member 92. The axis 170 thus is directed toward the center plane 88; however, the axis 70 is not normal to the center plane 88 as shown in FIG. 2.

As thus described, the VVT mechanisms 148 and the camshaft drive mechanism 120 uses the top portions of the intake camshafts 110 in common. The illustrated engine thus can be smaller even though the engine incorporate both the VVT mechanism and the camshaft drive mechanism.

Additionally, the illustrated control valve units 166 are disposed in a relatively large space defined by the engine body 102 and the top cowling member 70 because the respective outer surfaces of the cylinder head members 92 are inclined relative to the top cowling member 70. This is also advantageous because the protective cowling assembly 66 does not need to be large for incorporating the VVT mechanisms 148 and the control valve units 166 do not prevent the top cowling member 70 from being either attached or detached.

Figure 4:
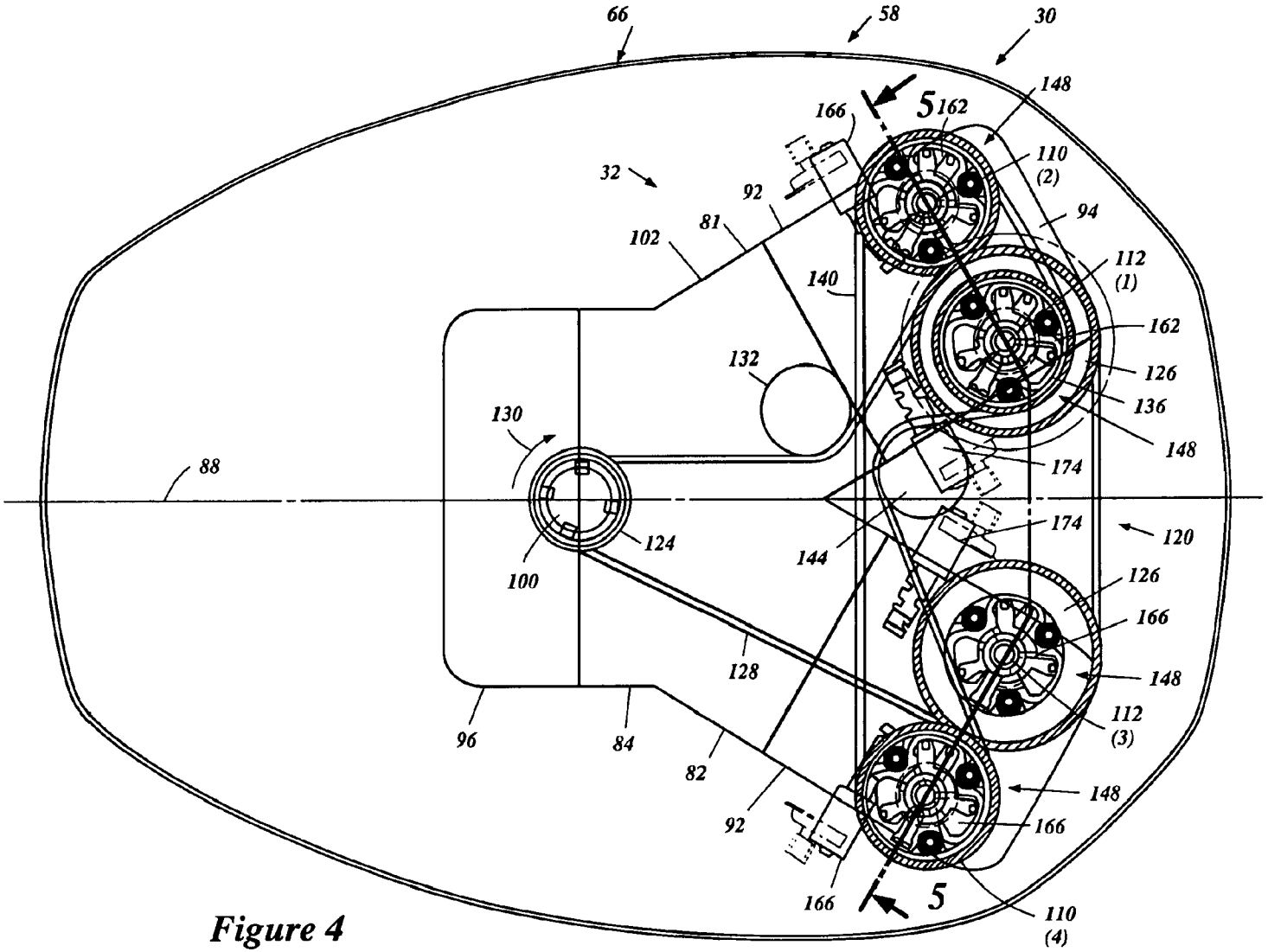
FIG. 4 is a top plan view of another outboard motor incorporating a modified engine in accordance with a second embodiment of the present invention. A top cowling of the outboard motor is detached in this figure to show the modified engine. The engine is somewhat schematically illustrated.
Figure 5:
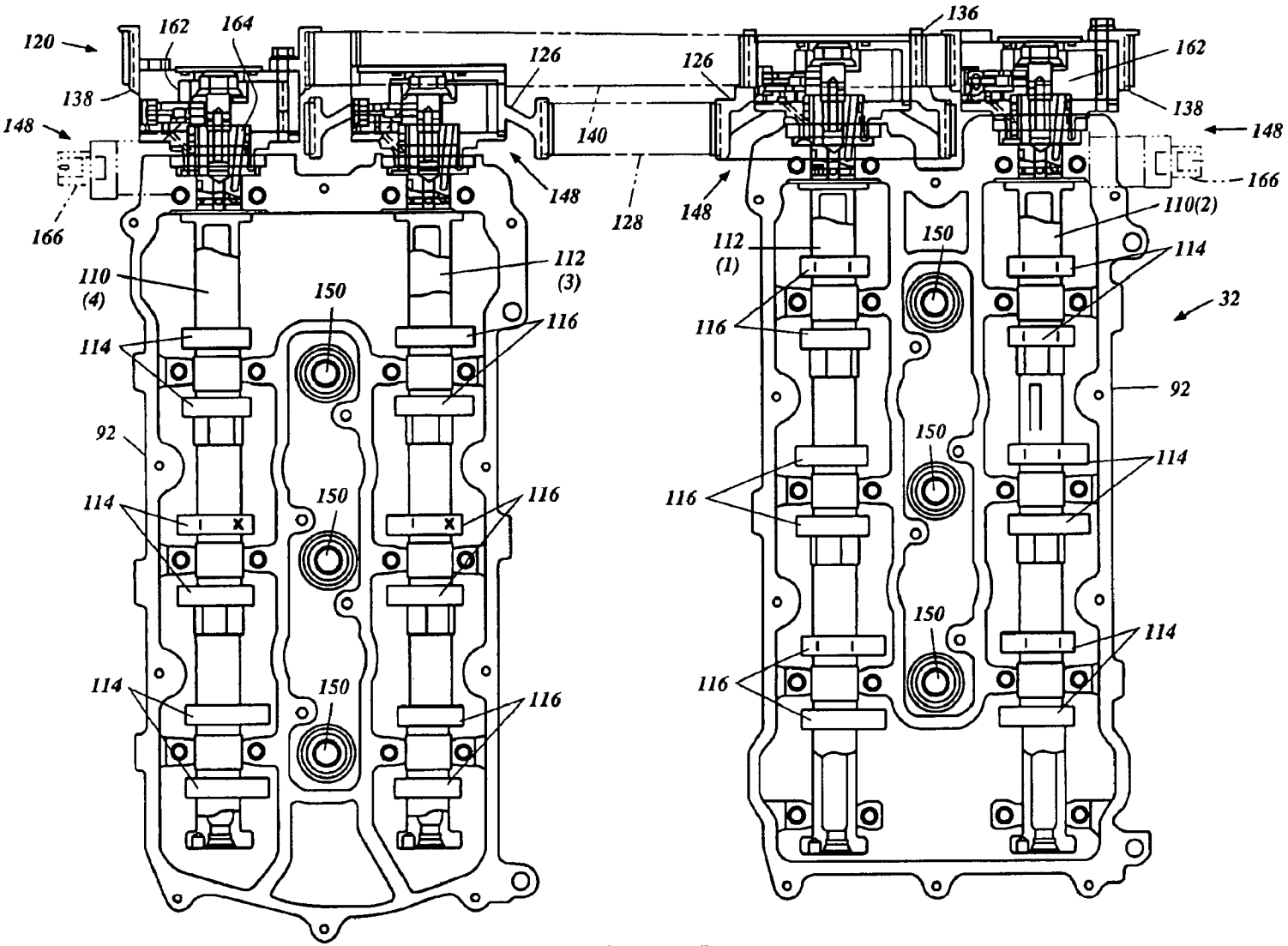
FIG. 5 is a cross-sectional view of the engine taken along the line 5—5 of FIG. 4, and illustrates in phantom control valve units of VVT mechanisms associated with intake camshafts of the engine. The control valve units of the exhaust camshaft VVT mechanisms have not been illustrated in order to simplify the drawings.

FIGS. 4 and 5 illustrate a modified arrangement configured in accordance with another embodiment of the present invention. The devices, units, components and members that have been already described above are assigned with the same reference numerals and will not be described again.

In this modified arrangement, the exhaust camshafts 112 also are provided with the VVT mechanisms 148. Each VVT mechanism 148 is disposed at the top portion of each exhaust camshaft 112. Each control valve unit 174, which has the same construction as the control valve unit 166, is disposed on another outer surface of the cylinder head member 92 which is opposed to the outer surface on which the control unit 166 is disposed. The control valve units 174 thus lie generally back-to-back with each other in the valley formed between the respective banks B1, B2. The control valve units 174 are arranged inside the timing chain 128 and lie (at least in part) generally at the same vertical level as the timing chain 128 and the other control valve units 166.

In this arrangement, the engine can also be small because the VVT mechanisms 148 still are disposed on the same level as the camshaft drive mechanism 120.

Of course, the foregoing description is that of preferred constructions having certain features, aspects and advantages in accordance with the present invention. Various changes and modifications may be made to the above-described arrangements without departing from the spirit and scope of the invention, as defined by the appended claims. For instance, the first drive can be located above the second drive. Either one or both of the first and second drives can be located inside of the engine body. Also, both the first and second drives can be located below the engine body, and the location of the VVT mechanisms preferably depends on the location of at least one camshaft drive transmitters. Accordingly, the scope of the present invention should not be limited to the illustrated configurations, but should only be limited to a fair construction of the claims that follow and any equivalents of the claims.

What is claimed is:

1. An internal combustion engine comprising an engine body defining first and second banks together forming a V-shape, a crankshaft extending within the engine body and rotating about a crankshaft axis, first and second camshafts extending within the first bank, third and fourth camshafts extending within the second bank, the first, second, third and fourth camshafts being generally disposed parallel to one another and parallel to the crankshaft, the first and third camshafts being placed next to each other, a first flexible transmitter extending around the crankshaft and the first and third camshafts such that the crankshaft drives the first and third camshafts through the first transmitter, and a second flexible transmitter extending around the second and fourth camshafts and either the first or third camshaft such that the first or third camshaft drives the second and fourth camshafts through the second transmitter, the first and second transmitters being arranged next to each other in a direction extending parallel to the crankshaft axis.

2. The engine as set forth in claim 1, wherein one of the first and second transmitters lies between the first and second banks and the other one of the first and second transmitters.

3. The engine as set forth in claim 2 additionally comprising a change mechanism associated with at least one of the first, second, third and fourth camshafts, the change mechanism changing an angular position of the corresponding first, second, third or fourth camshaft relative to the crankshaft, at least a portion of the change mechanism being disposed between one of the first and second transmitters and one of the first and second banks.

4. The engine as set forth in claim 3, wherein the change mechanism is hydraulically operated, and said portion of the change mechanism includes a control valve unit that controls the hydraulic operation of the change mechanism.

5. The engine as set forth in claim 4, wherein each one of the first and second banks comprises first and second members that are coupled together, the first member is positioned closer to the crankshaft than the second member, the first, second, third and fourth camshafts are interposed between the first and second members at the respective banks, and the control valve unit is located next to one of the first members.

6. The engine as set forth in claim 5, wherein the engine is enclosed in a cowling, and the control valve unit is disposed between the engine body and the cowling.

7. The engine as set forth in claim 1 additionally comprising a plurality of intake valves and a plurality of exhaust valves, the first and third camshafts actuating the exhaust valves, and the second and fourth camshafts actuating the intake valves.

8. The engine as set forth in claim 7, wherein the crankshaft extends generally vertically.

9. The engine as set forth in claim 8, wherein at least one of the first and second flexible transmitters is disposed above the engine body.

10. The engine as set forth in claim 9, wherein both of the first and second flexible transmitters are disposed above the engine body.

11. The engine as set forth in claim 8, wherein the first and second transmitters are disposed in vertical above one another.

12. The engine as set forth in claim 11 additionally comprising variable valve timing mechanisms operate with at least the second and fourth camshafts, each variable valve timing mechanism including an oil control valve, at least a portion of each oil control valve is disposed below of the uppermost one of the first and second transmitters.

13. The engine as set forth in claim 12, wherein each bank includes a cylinder head and a cylinder head cover that fit together at mating surfaces, and each oil control valve is disposed on a same side of the mating surfaces to which the crankshaft lies.

14. An internal combustion engine for an outboard motor comprising an engine body, a crankshaft extending generally vertically within the engine body, a plurality of camshafts wherein at least one camshaft extends generally vertically and generally parallel to the crankshaft within the engine body, a transmitting device comprising a first transmitter and a second transmitter, the crankshaft driving a first camshaft through the first transmitter, the first camshaft driving a second camshaft through the second transmitter, the first transmitter is positioned between the second transmitter and the engine body, and a change mechanism configured to change an angular position of one of the first or second camshafts relative to the crankshaft, at least a portion of the change mechanism being disposed generally next to a portion of the camshaft, the transmitting device at least in part overlapping in a vertical direction with said portion of the change mechanism.

15. The engine as set forth in claim 14, wherein the change mechanism is hydraulically operated, said portion of the change mechanism includes a control valve unit that controls the hydraulic operation of the change mechanism.

16. The engine as set forth in claim 14 wherein the plurality of the camshafts being divided into a first group and a second group, the first group comprises the first camshaft and a third camshaft, the second group comprises the second camshaft and a fourth camshaft, the crankshaft driving the first group through the first transmitter, the first group driving the second group through the second transmitter, and one of the first and second transmitters overlapping with said portion of the change mechanism in the vertical direction.

17. The engine as set forth in claim 16, wherein the engine body defining first and second banks together forming a V-shape, each one of the first and second banks includes one camshaft of the first group and one camshaft of the second group, the camshaft of the first group drives the camshaft of the second group in at least one of the first and second banks.

18. An internal combustion engine for outboard motor comprising an engine body, a crankshaft extending generally vertically within the engine body, a plurality of camshafts and at least one camshaft extending generally vertically and generally parallel to the crankshaft within the engine body, a transmitting device arranged to transmit a driving force to the camshaft from the crankshaft, and a change mechanism configured to change an angular position of the camshaft relative to the crankshaft, at least a portion of the change mechanism being disposed generally next to a portion of the camshaft, the transmitting device at least in part overlapping in a vertical direction with said portion of the change mechanism, the camshafts being divided into at least first and second groups, the transmitting device comprising first and second transmitters, the crankshaft driving the first group through the first transmitter, the first group driving the second group through the second transmitter, and one of the first and second transmitters overlapping with said portion of the change mechanism in the vertical direction, wherein the engine body defines first and second banks together forming a V-shape, each one of the first and second banks includes one camshaft of the first group and one camshaft of the second group, the camshaft of the first group drives the camshaft of the second group in at least one of the first and second banks, and wherein the camshaft of the first group in the first bank drives both the camshafts of the second group.

19. The engine as set forth in claim 16, wherein at least the first or second transmitters of the transmitting device extends above of the engine body.

20. The engine as set forth in claim 16, wherein one of the first and second transmitters is arranged above the other one of the first and second transmitters.

21. An outboard motor comprising an internal combustion engine, a cowling arranged to enclose the engine, the engine comprising an engine body defining first and second banks together forming a V-shape, a crankshaft extending within the engine body and rotating about a crankshaft axis, first and second camshafts extending within the first bank, third and fourth camshafts extending within the second bank, the first second, third and fourth camshafts being generally disposed parallel to one another and parallel to the crankshaft, the first and third camshafts being placed next to each other, a first flexible transmitter extending around the crankshaft and the first and third camshafts such that the crankshaft drives the first and third camshafts through the first transmitter, and a second flexible transmitter extending around the second and fourth camshafts and either the first or third camshaft such that the first or third camshaft drives the second and fourth camshafts through the second transmitter, the first and second transmitters being arranged next to each other in a direction extending parallel to the crankshaft axis.

22. An outboard motor comprising an internal combustion engine, a cowling arranged to enclose the engine, the engine comprising an engine body, a crankshaft extending generally vertically within the engine body, at least one camshaft extending generally vertically and generally parallel to the crankshaft within the engine body, a transmitting device comprising a first flexible transmitter and a second flexible transmitter offset from the first flexible transmitter, the first flexible transmitter extending around the crankshaft and the camshaft and arranged to transmit a driving force to the camshaft from the crankshaft, and a change mechanism configured to change an angular position of the camshaft relative to the crankshaft, at least a portion of the change mechanism being disposed generally next to a portion of the camshaft, the transmitting device at least in part overlapping in a vertical direction with said portion of the change mechanism and the first flexible transmitter surrounding the change mechanism.

23. The outboard motor as set forth in claim 22, wherein a first distance separates the first flexible transmitter from the engine body and a second distance separates the second flexible transmitter from the engine body, and the first distance is less than the second distance.

24. The engine as set forth in claim 14, wherein the change mechanism is hydraulically operated, said portion of the change mechanism includes a control valve unit that controls the hydraulic operation of the change mechanism and is surrounded by the first transmitter.

* * * * *

UNITED STATES PATENT AND TRADEMARK OFFICE

CERTIFICATE OF CORRECTION

PATENT NO. : 6,877,467 B2
DATED : April 12, 2005
INVENTOR(S) : Goichi Katayama

It is certified that error appears in the above-identified patent and that said Letters Patent is hereby corrected as shown below:

Column 13,
Line 9, after “for” insert -- an --.

Column 14,
Line 3, after “first” insert -- , --.

Signed and Sealed this

Tenth Day of January, 2006

JON W. DUDAS
*Director of the United States Patent and Trademark Office*